US006547881B1

(12) United States Patent
Klöckner

(10) Patent No.: US 6,547,881 B1
(45) Date of Patent: Apr. 15, 2003

(54) PAPER DISPENSER

(76) Inventor: Lothar Klöckner, Am Krusenhof 73, D-46286 Dorsten-Lembeck (DE)

( * ) Notice: Subject to any disclaimer, the term of this patent is extended or adjusted under 35 U.S.C. 154(b) by 0 days.

(21) Appl. No.: 09/762,849

(22) PCT Filed: Nov. 8, 1999

(86) PCT No.: PCT/DE99/02516

§ 371 (c)(1),
(2), (4) Date: Mar. 27, 2001

(87) PCT Pub. No.: WO00/08993

PCT Pub. Date: Feb. 24, 2000

(30) Foreign Application Priority Data

Aug. 14, 1998 (DE) ..... 198 36 932

(51) Int. Cl.[7] ..... B05C 1/08

(52) U.S. Cl. ..... 118/264; 118/268; 118/423; 118/420

(58) Field of Search ..... 118/264, 268, 118/423, 420; 206/233, 812; 221/45

(56) References Cited

U.S. PATENT DOCUMENTS 3,025,829 A * 3/1962 Smith ..... 118/221
4,991,538 A * 2/1991 Davids et al. ..... 118/231

FOREIGN PATENT DOCUMENTS

| | | |
|---|---|---|
| DE | 34 04 164 A1 | 8/1985 |
| DE | 38 00 494 A1 | 8/1989 |
| DE | 42 43 408 A1 | 6/1994 |
| DE | 94 16 976.4 U1 | 1/1995 |
| DE | 298 09 967 U1 | 12/1998 |
| EP | 0 219 981 | 4/1987 |
| GB | 515689 | 12/1939 |
| WO | WO 92/08403 | 5/1992 |

* cited by examiner

*Primary Examiner*—Laura Edwards
(74) *Attorney, Agent, or Firm*—Rutan & Tucker, LLP; Robert D. Fish

(57) ABSTRACT

The invention relates to a paper dispenser, especially to a paper dispenser for moistening reel paper.

10 Claims, 3 Drawing Sheets

PAPER DISPENSER

Figure 1:
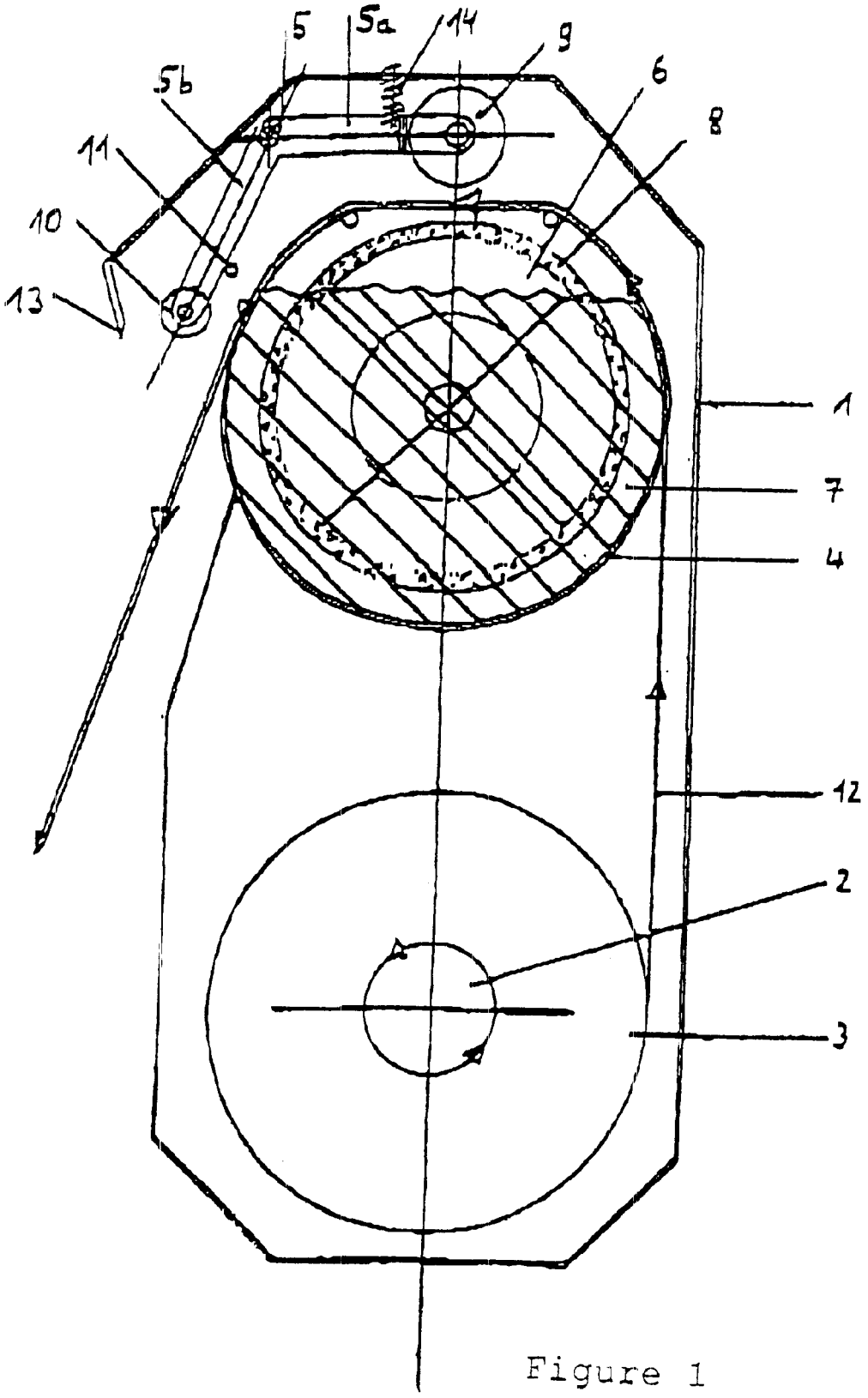

The invention relates to a paper dispenser, especially to a paper dispenser for moistening reel paper.

Paper dispensers for moistening reel paper are known from the prior art.

DE 42 43 408 A1 discloses a toilet paper holder with a paper moistening device. This paper holder comprises a regulator, which can be set to an ON and an OFF position. Depending on the setting of the regulator, dry or moist paper can be drawn from the paper holder. With the regulator in the ON position, the paper, on being drawn out, is guided over a moistening roller, which is rotatably mounted in a container which can be filled with water, and can moisten the paper. With the regulator in the OFF position, the paper guide is changed. In this case, the paper slides over a bushing and does not come in contact with the moistening roller, so that the paper cannot be moistened by it.

However, with the regulator in the ON position a satisfactory moistening of the paper can only take place if the paper is tensioned, since only then is contact guaranteed between the moistening roller and the paper. It does occur, however, that if the paper is continuously unwound the paper roll rotates so quickly that within a short period more paper is unwound from the roll than is being drawn out. The paper is then no longer tensioned and moistening is no longer guaranteed.

If no paper is drawn out with the regulator in the ON position, but the paper is tensioned, the paper is in contact with the moistening roller for an extended period, as a result of which the risk of excessive moistening arises, so that the paper may tear the next time it is drawn out. In addition, the regulator is not convenient to use, since before the paper holder is used the regulator setting must be checked by each new user and reset if desired.

DE 3800494 A1 discloses a toilet paper dispenser for moist or dry toilet paper. The paper is unwound from the paper roll by actuating a transport lever, and the moistening roller is guided beneath the transport surface of the paper by means of a tensioning lever. However, the paper from this paper dispenser can only be withdrawn in sections of predetermined length and not continuously, whereby the transport lever needs to be actuated for the removal of each section of paper. In addition to this, the operation of the paper dispenser is awkward, since two levers are to be actuated in order to moisten the paper.

DE 94 16 976 U1 discloses an automatic dispenser for moist toilet paper. This paper dispenser for the dispensing of moist paper features a paper transport device driven by a motor. The manufacture of such a paper dispenser, however, is elaborate and expensive.

According to the invention, a paper dispenser is created having a rotatably supported paper roll, onto which a paper web is wound, a liquid container provided with an aperture in the top, a moistening roller arranged rotatably in the liquid container, and a contact pressure device, which is capable of adjustment from a stable normal position into an unstable moistening position, and at which a pressure roller is rotatably arranged, which in the normal position is held at a distance above the moistening roller. The paper web unwound from the paper roll is guided between the contact pressure roller and the moistening roller at a distance from the latter. In addition, in the moistening position of the contact pressure device the paper web is pressed by the pressure roller in contact against the moistening roller.

By means of the contact pressure device according to the invention, it is guaranteed that, when moist paper is drawn out, the paper web will be pressed by the contact pressure roller against the moistening roller. Accordingly, in the moistening position of the contact pressure device, a sustained contact between the paper web and the moistening roller, and therefore a constant moistening of the paper web, will be ensured.

The moistening position of the contact pressure device is unstable, with the result that the contact pressure device is automatically reset into the stable normal position if the contact pressure device is no longer actuated. This causes the paper web to be removed again from the moistening roller, and an unintentional or excessive moistening of the paper can be avoided and therefore the tearing of the paper web prevented.

The paper can be withdrawn continuously from the paper holder according to the invention, so that the length of the paper sections which a user can draw off is not specified.

In addition, the paper holder according to the invention does not feature a motor-driven paper transport device, and can therefore be manufactures easily and cost-effectively.

The contact pressure device according to the invention can be designed in different manners. According to one embodiment, the contact pressure device is designed as a contact device. In this case, the paper dispenser according to the invention is designed for a two-handed operation; i.e. while the user draws the paper out with one hand, for example, he can actuate the contact pressure device with the other hand.

For preference, however, the paper dispenser is actuated in single-hand operation. For this purpose, the contact pressure device has a pivot-mounted two-armed lever, on one lever arm of which the contact pressure roller is arranged in a rotatable manner, and the other lever arm of which is capable of being pivoted upwards by raising the section of the paper web being unwound with the pivoting of the pressure roller into the moistening position, whereby a resetting spring engages at the lever in order to reset the pressure roller into the normal position. The contact pressure device can be moved into the moistening position by simple raising of the paper web against the other lever arm. This leads to convenient operation of the paper dispenser according to the invention, and further has the advantage that no user needs to actuate a separate operating element by hand, which is desirable from the point of view of hygiene.

The moistening roller can project upwards out of the aperture of the liquid container, whereby the paper web is guided at a distance above the aperture of the liquid container. For preference, however, the moistening roller is arranged beneath the plane of the aperture in the liquid container, whereby provision in made at the liquid container for guide elements in the area of the aperture to guide the paper web, and the paper web is laid on the liquid container so as to cover the aperture.

If the entire width of the paper web is moistened, the risk pertains that the paper will tear, because moist paper features less tensile strength than dry paper. For this reason, according to one embodiment, circumferential grooves are provided in the moistening roller, which do not contribute to the moistening, as a result of which dry area are formed on the paper web, which increase the tensile strength of the moistened paper.

According to another embodiment, to form dry areas the moistening roller is formed of several moistening rollers arranged coaxially at a distance from one another.

For preference the moistening roller is provided at its circumference with a suction layer. When the moistening roller rotates, the suction layer can draw liquid with it out of the liquid container and apply it to the paper. This has the particular advantage that, by the selection of different suction layer materials, the volume of moisture applied to the paper can be adjusted.

The paper roll can, for example, be supported lying on the base of a housing. For preference, however, the paper dispenser features a paper roll holder, to hold the paper roll in a rotatable manner.

The paper can, for example, be used as a disinfection tissue, as a cleaning tissue, or as a refreshment tissue. According to one embodiment, therefore, a liquid is contained in the liquid container which contains a disinfection agent, a cleaning agent, and/or an aromatic agent.

The paper dispenser according to the invention can be used in the sanitary sector, in hospitals, in kitchens, etc. In these situations, it may be disturbing if the liquid remains adhering to the surface of the paper and is not absorbed into the paper. Accordingly, the paper dispenser is used for preference for the dispensing of absorbent paper, and of toilet paper in particular, kitchen roll paper, or hand cleaning paper.

Figure 2:
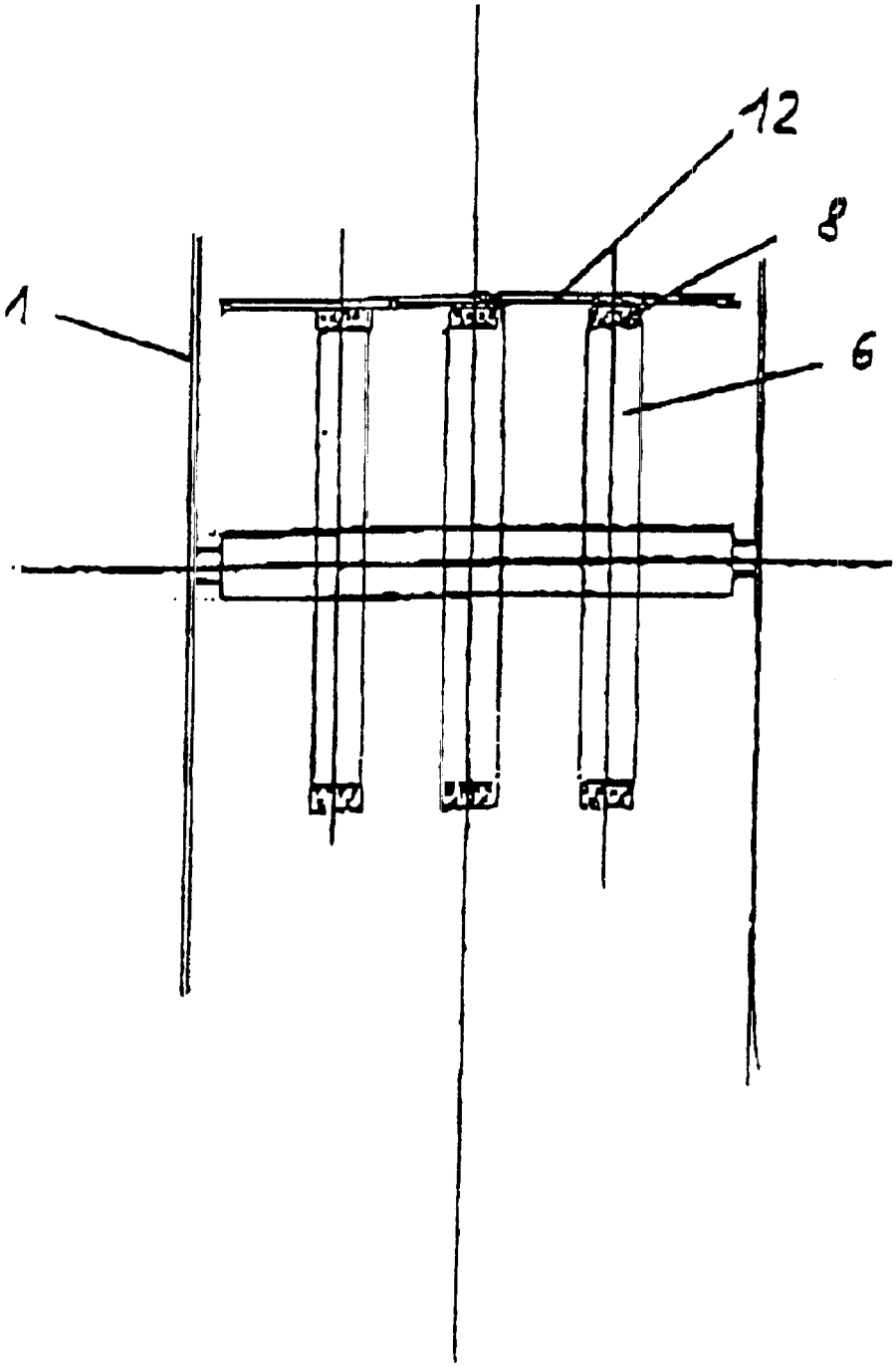
Figure 3:
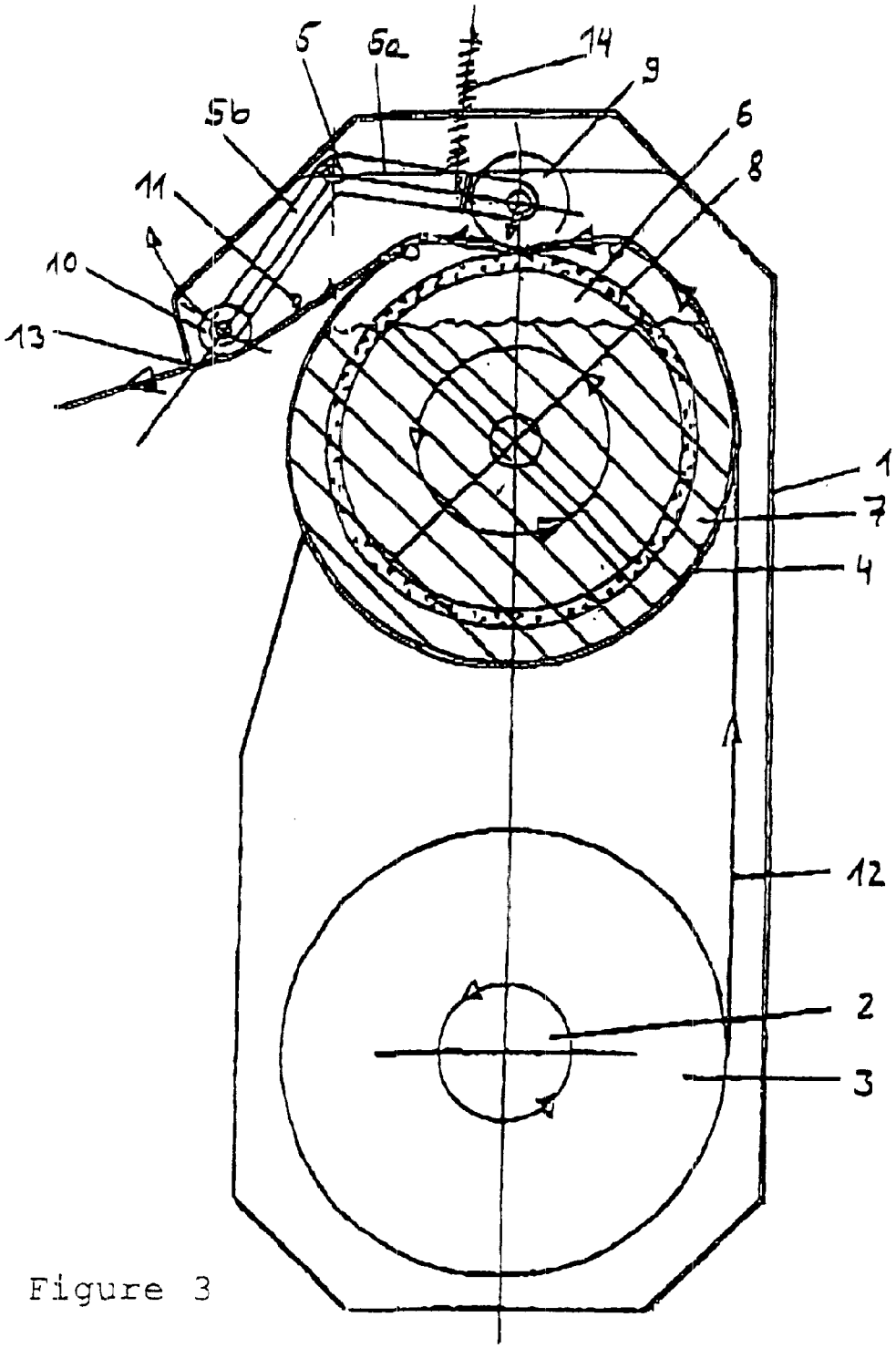

The invention is described on the basis of an embodiment making reference to the drawings. The drawings show:

FIG. 1 a sectional view of the embodiment of the paper dispenser according to the invention, in a normal state, in which no paper is moistened;

FIG. 2 a sectional view of the moistening rollers used according to the embodiment; and FIG. 3 a sectional view of the embodiment according to FIG. 1 in a moistening state, in which the paper is moistened.

From FIG. 1, a sectional view of an embodiment of the paper dispenser according to the invention can be seen, in a stable normal state, in which no paper is moistened. According to this embodiment, the paper dispenser comprises a housing 1, in which are arranged a paper roll holder 2, a liquid container 4 provided with an aperture in the top, and a two-armed lever 5, in this sequence one above the other.

A paper roll 3 is held in a rotatable manner by the roll holder 2, on which a paper web 12 is wound. In this situation the roll holder 2 is designed in such a way that the easy unwinding of the paper web 12 from the paper roll 3, and the easy replacement thereof are made possible.

The liquid container 4 is cylindrical in shape, whereby its essentially circular cross-section is cut by a horizontal plane, and the cutting surface forms the aperture of the liquid container 4.

Three moistening rollers 6 are arranged in the liquid container 4, beneath the aperture and capable of rotation on a common axis, which runs parallel to the roll axis of the paper roll 3. The three moistening rollers 6 together form one moistening roller, feature the same diameter, and are, as can be seen from FIG. 2, arranged next to one another. In addition, the distance between two adjacent moistening rollers 6 is constant.

The liquid container 4 is filled with a refillable liquid 7, whereby the volume of the liquid 7 which is filled is to be determined in such a way that the moistening rollers 6 in part project upwards out of the liquid 7. When the moistening rollers 6,rotate, parts of the moistening rollers 6 continuously covered with liquid are moved out of the liquid and then immersed into the liquid again.

At their circumference the moistening rollers 6 are for preference coated with a suction layer 8, which is moistened with the liquid 7 at the parts of the moistening rollers 6 which are immersed in the liquid 7. The suction layer 8 in this situation is designed in such a way that it carries a part of the liquid 7 with it into the area above the level of the liquid when the moistening rollers 6 are rotated.

The two lever arms 5*a* and 5*b* of the lever 5 are fixed and connected as one piece, forming an obtuse angle to one another. At the connection point of the two lever arms 5*a* and 5*b* the lever 5 is secured to the housing in a pivotable manner, whereby the pivot axis runs parallel to the rotational axis of the moistening rollers 6.

The lever 5 comprises a contact pressure roller 9 and a control roller 10. In one position of the lever 5, designated as the stable normal position, one of the lever arms 5*a* runs approximately horizontal above the liquid container 4, while by contrast the second lever arm 5*b* extends downwards at an angle from the horizontal and away from the liquid container 4.

For preference the lever arm 5*b* turned away from the moistening roller features a greater length than the lever arm 5*a*, and for preference the lever arm 5*b* is double the length of the lever arm 5*a*, so that, at actuation, a better transfer of force onto the contact pressure roller can be exerted, and after the paper is torn off the pressure roller 9 is released from the moistening roller 6.

This pressure roller 9 is arranged in a rotatable manner at the outer end of the first lever arm 5*a*, whereby the axis of rotation of the pressure roller 9, the axis of rotation of the moistening rollers 6, and the roller axis of the paper roll 3 lie in the same vertical plane. The control roller 10 is arranged in a rotatable manner at the end of the second lever arm 5*b*, whereby the axis of rotation of the control roller 10 runs parallel to the pivot axis of the lever 5. In a simple manner the control roller 10 is designed in the form of, for preference, a thick-walled and therefore relatively heavy tube, so that, after the paper has been torn off, because of the weight of the-control roller and of the longer lever arm 5*b*, the pressure roller is released from the moistening roller 6.

In order to hold the lever 5 in the normal position, a tension spring 14 is secured at the first lever arm 5*a*, by means of which the first lever arm 5*a* is drawn upwards. If the lever 5 is not in its normal position, it can pivot backwards into its normal position because of the spring force, i.e. the first lever arm 5*a* with the pressure roller 9 pivots away from the liquid container 4, and the second lever arm 5*b* with the control roller 10 pivots onto the liquid container 4. The direction of rotation of this pivoting movement is designated hereinafter as the positive pivoting direction. By analogy, the opposite direction of rotation is designated as the negative pivoting direction. In order to prevent the lever 5 from pivoting outwards beyond the normal position when it pivots backwards, the pivot range of the lever 5 is limited by a lever stop 11, which is arranged between the second lever arm 5*b* and the liquid container 4. When it pivots back, the second lever arm 5*b* strikes against the lever stop 11 and is therefore held in the normal position.

The paper web 12 runs from the paper roll 3 out over the aperture of the liquid container 4 between the moistening rollers 6 and the contact pressure roller 9, whereby the paper web 12 is not in contact, in the normal position of the lever 5, with either the moistening rollers 6 or their suction covers 8, or with the contact pressure roller 9. In addition, the paper web 12 is guided between the liquid container 4 and the control roller 10 downwards through a housing aperture out of the housing 1.

From FIG. 3 a sectional view of the embodiment of the paper dispenser according to the invention can be seen, in an unstable moistening state, in which the paper is moistened. In this situation the paper web 12 guided out of the housing 1 is drawn upwards in such a way that it presses against the control roller 10 of the lever 5, and therefore exerts a force on it. The force exerted by the paper web 12 on the lever 5 has the effect that the lever is pivoted against the spring force of the tensioning spring 14 in the negative pivoting direction. In this situation the paper web 12 is pressed by the pressure roller 9 against the moistening roller 6. In this position of the lever 5, which is designated as the unstable moistening position, the part of the paper web 12 which is pressed by the pressure roller 9 is in contact with the suction covers 8 of the moistening rollers 6, whereby the suction covers 8 give off a part of the moisture 7 they have carried with them onto the paper, and so moisten it.

The paper web 12 can therefore be drawn out of the housing 1 in two ways, in order optionally to obtain dry or moist paper.

To obtain dry paper, the paper web 12 is drawn out of the housing 1 by the user in a first drawing direction T, which is defined in such a way that the control roller 10 is either not touched by the paper web 12, or insufficient force is exerted by the paper web on the control roller 10 to cause the lever 5 to pivot against the spring force into the moistening position.

To obtain moist paper, the paper web 12 is raised by the user and pressed against the moistening roller 10. In this situation, the paper web 12 is drawn out in a second drawing direction F out of the housing 1, which is defined in such a way that the force exerted by the paper web 12 on the control roller 10 is sufficiently great to cause the lever 5 to pivot against the spring force in the negative pivoting direction into the moistening position.

By drawing out the paper web 12 from the housing 1 in the second drawing direction F, the pressure contact roller 9 and the moistening rollers 6 are set in rotation, due to the friction which pertains between the paper web 12 and the pressure roller 9 on the one hand and the paper web 12 and the moistening rollers on the other. The rotation of the pressure roller 9 facilitates the withdrawal of the paper web 12 and reduces the risk of a paper tear. In addition, the rotation of the moistening rollers 6 when the paper web 12 is drawn out also ensures that the paper is moistened continuously by the suction covers 8 of the moistening rollers 6.

Moistened paper has in general less tensile strength than dry paper, and the risk pertains that the moistened paper will tear when it is drawn out. Because there are gaps provided between the moistening rollers 6, the paper web 12 is not moistened over the entire width of the paper, as a result of which dry or less moist areas are formed on the paper web 12. The dry or less moist areas are formed in the longitudinal direction of the paper 12 as it is drawn out, and increase its tensile strength. This achieves the situation that the moistened paper web 12 does not tear when it is drawn out.

In the upper part of the housing aperture a tearing edge 13 is provided at the housing 1, arranged parallel to the pivot axis, which for preference, by contrast with the representation of the embodiment shown here, lies beneath the control roller 10. Once the user has drawn out the desired length of the paper web 12 from the housing 1, he can draw it approximately vertical in this case, upwards against the tearing edge 13, so that the paper web 12 is separated by the edge. In order to ensure the reliable release of the paper from the moistening roller in this embodiment, it is also possible to make provision for a spring-supported raising element for the paper, or a U-shaped wire bar, secured at each end face at the pivot axis of the pressure roller 9, guided downwards beneath the paper, which, after the control roller 10 is released, raises the paper from the moistening roller 6 and so prevents the paper from being moistened right through.

This embodiment of the paper dispenser according to the invention features in particular the advantage of being able to be used with one hand; i.e. the user can control all the functions of the paper dispenser with one hand.

Because the paper web 12 in the normal position of the pressure roller 9 is guided at a distance from this roller also, between the pressure roller 9 and the moistening roller 6, the paper web 12 likewise cannot be moistened right through by residual moisture on the pressure roller 9 from the previous moistening process.

What is claimed is:

1. A paper dispenser having:

a rotatably supported paper roll (3), on which a paper web (12) is wound, a liquid container (4) provided with an aperture in the top, a moistening roller (6) arranged in a rotatable manner in the liquid container (4), and a contact pressure device, which is capable of displacement out of a stable normal position into an unstable moistening position, and at which a pressure roller (9) is arranged in a rotatable manner, which in the normal position is held at a distance from the moistening roller (6), whereby the paper web (12) unwound from the paper roll (3) is guided between the pressure roller (9) and the moistening roller (6) at a distance from it, and in the moistening position of the contact pressure device, the paper web (12) is pressed by the pressure roller (9) against The moistening roller (6);

whereby the contact pressure device comprises a pivot-mounted two-armed lever (5), on one lever am **(5*a*) of which the pressure roller (9) is arranged in a pivoting manner, and The other lever arm (5*b*) of which is capable of being pivoted upwards by the raising of the running section of the paper web (12), under the pivoting downwards of the pressure roller (9) into the moistening position, whereby a resetting spring (14) engages at the lever (5) to reset the pressure roller (9)** into the normal position.

2. The paper dispenser according to claim 1 whereby the moistening roller (6) is arranged beneath the aperture plane in the liquid container (4), guide elements are provided for at the liquid container (4) in the area of the aperture, for guiding the paper web (12), and the paper web (12) is in contact at the liquid container (4), covering the aperture.

3. The paper dispenser according to claim 1 whereby the moistening roller (6) is provided at its circumference with a suction cover.

4. The paper dispenser according to claim 1 whereby circumferential grooves are formed at the moistening roller (6).

5. The paper dispense according to claim 1, whereby the moistening roller (6) is formed from several moistening rollers arranged next to one another and at a distance from one another.

6. The paper dispenser according to claim 1, further comprising a paper roll holder (2) for rotational holding of the paper roll (3).

7. The paper dispenser according to claim 1, whereby a liquid (7) is contained in the liquid container (4), said liquid comprising a disinfection medium, a cleaning median, and/or an fragrant agent.

8. The paper dispenser according to claim 1, whereby the paper web is guided between the pressure roller (9) and the moistening roller (16) in such a way that the paper web in the normal position of the pressure roller (9) runs at a distance from the moistening roller (6) as well as at a distance from the pressure roller (9).

9. The paper dispenser of claim 1 wherein the paper web comprises absorbent paper.

10. The paper dispenser of claim 1 wherein the paper web comprises toilet paper, kitchen roll paper, or hand cleaning paper.

* * * * *